US005966852A

United States Patent [19]

Drzewiecki

[11] Patent Number: 5,966,852

[45] **Date of Patent: *Oct. 19, 1999**

[54] DIRECTLY MACHINE PRINTABLE INDEX SHEET HAVING INDEX TAB PORTIONS

[75] Inventor: James J. Drzewiecki, Arlington Heights, Ill.

[73] Assignee: ACCO Brands, Inc., Lincolnshire, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/749,482

[22] Filed: Nov. 15, 1996

[51] Int. Cl.[6] ..... B42F 21/00

[52] U.S. Cl. ..... 40/360; 40/359; 40/641; 283/37; 283/39

[58] Field of Search ..... 40/360, 359, 641; 283/36, 37, 39; 281/2, 5; 402/79

[56] References Cited

U.S. PATENT DOCUMENTS

| | | | |
|---|---|---|---|
| Re. 5,144 | 11/1872 | Partridge . | |
| 529,477 | 11/1894 | Brown . | |
| 561,888 | 6/1896 | Hon . | |
| 612,078 | 10/1898 | Wickham . | |
| 764,701 | 7/1904 | Ayres . | |
| 783,365 | 2/1905 | Coleman . | |
| 843,416 | 2/1907 | Ohashi . | |
| 1,048,577 | 12/1912 | Pardoe, Jr. . | |
| 1,058,118 | 4/1913 | Wardy . | |
| 1,142,644 | 6/1915 | Vesterling . | |
| 1,151,475 | 8/1915 | Kingsley et al. . | |
| 1,428,102 | 9/1922 | Kelly . | |
| 1,429,436 | 9/1922 | Kelly . | |
| 1,501,234 | 7/1924 | Rand . | |
| 1,559,129 | 10/1925 | Pimm . | |
| 1,777,499 | 10/1930 | Kupfer . | |
| 1,861,259 | 5/1932 | Brasseur . | |
| 1,922,213 | 8/1933 | Middleton | 129/16.7 |
| 1,924,755 | 8/1933 | Rubin . | |
| 2,001,651 | 5/1935 | Bingham | 129/24 |
| 2,300,623 | 11/1942 | Hornung . | |
| 2,345,793 | 4/1944 | Chapel | 129/16.7 |
| 2,502,785 | 4/1950 | Gottschalk . | |
| 2,576,272 | 11/1951 | Adelman | 40/102 |
| 3,454,451 | 7/1969 | Buckholz | 156/513 |
| 3,770,943 | 11/1973 | Sill | 235/61.12 R |
| 3,970,397 | 7/1976 | Armstrong | 402/79 |

(List continued on next page.)

FOREIGN PATENT DOCUMENTS

| | | | |
|---|---|---|---|
| 2-92696 | 4/1990 | Japan . | |
| 219435 | 3/1968 | Sweden | 40/79 |
| 23716 | 10/1897 | United Kingdom . | |
| WO 93/04943 | 3/1993 | WIPO . | |

OTHER PUBLICATIONS

ACCO USA, Inc., Wheeling, Ilinois, *Perma Day–Timer and Fact Book,* pp. 29–34, ©1995.

ACCO USA, Inc., Wheeling, Ilinois, *Multidex Index Product Brochure—Quick Reference Index System*, ©1992.

Duralon Product Brochure—excerpt.

JBC Design Group, Inc., Torrance, California, *Extend–A–Tab*™ Product Brochure—Dual–Insertable Tabs, ©1995.

*Primary Examiner*—William Stryjewski

*Attorney, Agent, or Firm*—Pennie & Edmonds LLP

[57] ABSTRACT

An index sheet which may be accommodated by and directly printed upon by a conventional printer. The index sheet is formed from a rectangular shaped stock sheet having a body portion, at least one index tab portion, and a guide portion, all of which are separated by a plurality of perforations. After the stock sheet is directly printed upon, the index sheet may be formed by removing the guide portion and any excess index tab portions so that a single index tab portion extends outwardly from the body portion to identify, separate, or otherwise distinguish the materials being indexed. A first plurality of index sheets stacked in a first position may be used with a second plurality of index sheets which are inverted and stacked in a second position to create a continuous staggered edge of index tab portions.

10 Claims, 5 Drawing Sheets

U.S. PATENT DOCUMENTS 4,043,573 8/1977 Griffin ..... 283/2
4,046,615 9/1977 Jansen ..... 156/544
4,127,690 11/1978 Schleifenbaum et al. ..... 428/40
4,184,699 1/1980 Lowe, Jr. ..... 281/41
4,240,848 12/1980 Barber ..... 156/64
4,422,672 12/1983 Levi ..... 283/39
4,430,015 2/1984 Nerlinger ..... 402/79
4,431,325 2/1984 Colby ..... 402/79
4,446,183 5/1984 Savagian ..... 428/42
4,447,481 5/1984 Holmberg et al. ..... 428/40
4,448,558 5/1984 Weingarten ..... 400/529
4,479,733 10/1984 Segal ..... 402/79
4,523,775 6/1985 Reist ..... 283/36
4,529,227 7/1985 Fields ..... 282/5
4,560,600 12/1985 Yellin et al. ..... 428/43
4,568,108 2/1986 Simpson ..... 281/5
4,636,179 1/1987 Gentile et al. ..... 402/79
4,643,452 2/1987 Chang ..... 283/62
4,643,455 2/1987 North et al. ..... 283/81
4,662,770 5/1987 Block ..... 402/80
4,704,317 11/1987 Hickenbotham et al. ..... 428/156
4,748,758 6/1988 Gaston ..... 40/359
4,773,676 9/1988 Showering ..... 281/2
4,779,897 10/1988 Schall et al. ..... 281/38
4,784,508 11/1988 Shannon ..... 402/79
4,802,692 2/1989 Stryd ..... 281/5
4,803,795 2/1989 Questel et al. ..... 40/124.2
4,810,544 3/1989 Hickman ..... 428/40
4,822,017 4/1989 Griesmyer ..... 271/2
4,844,508 7/1989 Choi ..... 281/15.1
4,865,477 9/1989 George ..... 400/531
4,884,826 12/1989 Slagsvol ..... 281/2
4,884,827 12/1989 Kelley ..... 283/81
4,887,925 12/1989 Groswith, III et al. ..... 402/15
4,910,066 3/1990 Foisie ..... 428/137
4,911,777 3/1990 Truc et al. ..... 156/252
4,923,111 5/1990 Down ..... 229/68 R
4,952,091 8/1990 Sirko ..... 402/79
4,952,433 8/1990 Tezuka et al. ..... 428/42
4,961,666 10/1990 Pitts et al. ..... 402/79
4,962,603 10/1990 Kao et al. ..... 40/641
4,972,952 11/1990 Reisender ..... 206/456
4,990,018 2/1991 Best et al. ..... 402/79
5,016,370 5/1991 Rhian et al. ..... 40/359
5,033,899 7/1991 Pitts et al. ..... 402/80 R
5,040,216 8/1991 Policht ..... 402/80 L
5,044,807 9/1991 Meservy et al. ..... 402/80 L
5,076,490 12/1991 Dulin ..... 229/92.8
5,125,561 6/1992 Idstein ..... 229/1.5 R
5,135,261 8/1992 Cusack et al. ..... 285/81
5,174,606 12/1992 Hure ..... 281/45
5,180,461 1/1993 Widmann ..... 156/216
5,187,888 2/1993 O'Brien et al. ..... 40/359
5,219,183 6/1993 McKillip ..... 283/62
5,228,388 7/1993 Brown ..... 101/226
5,299,879 4/1994 Burrow ..... 402/79
5,316,344 5/1994 Popat et al. ..... 283/81
5,333,908 8/1994 Dorney ..... 283/38
5,340,427 8/1994 Cusack et al. ..... 156/268
5,389,414 2/1995 Popat ..... 428/40
5,401,058 3/1995 Holmberg ..... 283/62
5,407,234 4/1995 Rettker et al. .
5,407,718 4/1995 Popat et al. ..... 428/40
5,447,336 9/1995 Deighton ..... 283/115
5,468,085 11/1995 Kline ..... 402/79
5,503,435 4/1996 Kline ..... 283/67
5,524,998 6/1996 Schwartz ..... 402/79
5,558,454 9/1996 Owen ..... 402/79
5,571,587 11/1996 Bishop et al. ..... 428/43
5,599,128 2/1997 Steiner ..... 402/79
5,601,313 2/1997 Konkol et al. ..... 283/81
5,662,976 9/1997 Popat et al. ..... 428/401
5,743,566 4/1998 Hunter et al. ..... 283/36
5,782,494 7/1998 Crandall et al. ..... 281/2
5,792,297 8/1998 Hunter et al. ..... 156/211

DIRECTLY MACHINE PRINTABLE INDEX SHEET HAVING INDEX TAB PORTIONS

FIELD OF THE INVENTION

The present invention relates generally to index sheets and, more particularly, to bindable index sheets which are directly printable upon, using machines, such as computer operated printers.

BACKGROUND OF THE INVENTION

Index tabs for quick identification and selection of information from looseleaf or hardbound binders are a common feature of nearly every well-organized office or home. Typically, these index tabs are provided as markings on certain sheets or pages of binders, books, notebooks, or other multiple sheet material. In order to facilitate ease of scanning and selecting pages, the index tabs are typically staggered or spaced, along the edge of the multiple sheet material. For example, a set of index tabs connected to the edge of spaced index sheets are positioned just far enough away from each other so that the identifying text or characters or symbols appearing on all index tabs can be seen simultaneously. Uses for such index tabs include simple referencing and presentations, among others.

A set of index sheets generally include a fixed number of index tabs which span the length of the material being indexed. The number of tabs usually ranges from about 3 to 8 or more.

In general, index tabs are made in one of two ways. The tabs may be integrally formed as protrusions of the sheets themselves as shown, for example, in U.S. Pat. No. 4,184,699 issued to Lowe on Jan. 22, 1980. Alternatively, the tabs may be separate components which are connected to the index sheets as shown, for example in U.S. Pat. No. 4,962,603 issued to Kao et al. on Oct. 16, 1990; U.S. Pat. No. 5,135,261 issued to Cusack et al. on Aug. 4, 1992; U.S. Pat. No. 5,340,427 issued to Cusack et al. on Aug. 23, 1994; and U.S. Pat. No. 5,389,414 issued to Popat on Feb. 14, 1995.

It is often desirable to produce index tabs using common office printers. As the Kao et al. patent indicates, forming index tabs as integral protrusions of the index sheets is difficult since it has been difficult to machine print identifying text on the index tabs. For example, it has been impractical to insert the entire index sheet into a standard typewriter in order to type text sideways onto the protruding index tab. It has also been difficult or impossible to feed index sheets directly through common office printers, such as laser printers, ink jet printers or office copiers, without encountering jamming problems, limited feed size problems, or distorted printing problems.

It is desirable to print index sheets using common office printers due to the great flexibility of what can be printed as well as the high print quality provided by such printers or the like. However, such printers require the sheet stock to be uniformly dimensioned, at least widthwise, according to standard sizes in order to be accommodated by the standard sized feeding tray and pathway of such printers. Otherwise, the sheet stock will either tend to jam within such printers or not even fit into such printers.

An index sheet is typically designed so that a portion of the sheet will extend past the boundary of the materials being indexed for easy viewing. As a result, index sheets are typically wider in size than the standard size accepted by a printing machine. Moreover, protruding tabs on the top or leading edge of index sheets which are first drawn into the printer, can jam or stray from the correct feed path. In addition, the sheet stock must be strong enough to withstand the stresses imposed on the sheets by the feeding mechanisms and pressure rollers, and must provide a uniformly smooth surface that will properly take up the toner. Because of these requirements, conventional index sheets having nonuniform widths due to protruding index tabs have been poorly suited for use in common office printers.

Several ways to produce a machine-printable index sheet have involved transforming the size of the index sheet to fit within the feed size width of the printing machine. This has been accomplished by such techniques as folding over a portion of the index sheet for printing purposes. While these techniques have been successful, the present invention is directed toward an index sheet which does not have to be folded or similarly manipulated in size prior to printing.

BRIEF SUMMARY OF THE INVENTION

The present invention is directed to an index sheet which can be used in combination with other index sheets to create a staggered series of index tabs extending along the length of the materials being indexed. The index sheet is formed from a rectangular shaped stock sheet having opposed top and bottom edges to define a length and opposed first and second side edges to define a width. The width of the stock sheet is dimensioned so as to be receivable in a printing machine as the sheet is fed along in the direction of its length. The length is also dimensioned to be properly received by the conventional printing machine. Typically, the stock sheet can have a dimension of 8½ by 11 inches or some other size typical of paper sheets. The index sheet, which includes a rear binding edge and print tab edge, is oriented on the stock sheet with the rear edge defined by the bottom edge of the stock sheet and with the tab edge extending across the stock sheet between its side edges. The tab edge is located adjacent to the top edge of the stock sheet but spaced therefrom by a guide portion. The guide portion together with the index sheet provides the rectangular shape of the stock sheet.

The guide portion is removable from the stock sheet along perforations to produce the index sheet. The perforations separating the index sheet from the guide edge of the stock sheet are located at a distance from the bottom edge of the stock sheet that is equal to the width, such as 8½ inches, of the material to be indexed. The tab portions of the index sheet, however, extend a suitable distance beyond this width.

With a stock sheet formed with an index sheet as described above, the feeding of the stock sheet through a printer is accomplished in the same manner as with a normal rectangular shaped sheet of paper. The printing on the tab portions is also accomplished in the normal way. In effect, the printer receives the stock sheet and performs its printing operation just as if it were a normal piece of paper.

Once the tab portions have been printed with the indexing information the index sheet is separated from the guide portion, the index sheet can be attached, along its binding edge, into a three ring binder. For this purpose the binding edge is provided with two holes suitably placed to cooperate with the middle ring and one of the end rings of the binder. A number of similar index sheets with differently positioned tab portions are similarly connected into the binder. Then an appropriate number of similar index sheets are connected into the binder using the center ring and the other of the end rings.

DETAILED DESCRIPTION OF THE INVENTION

Figure 1:
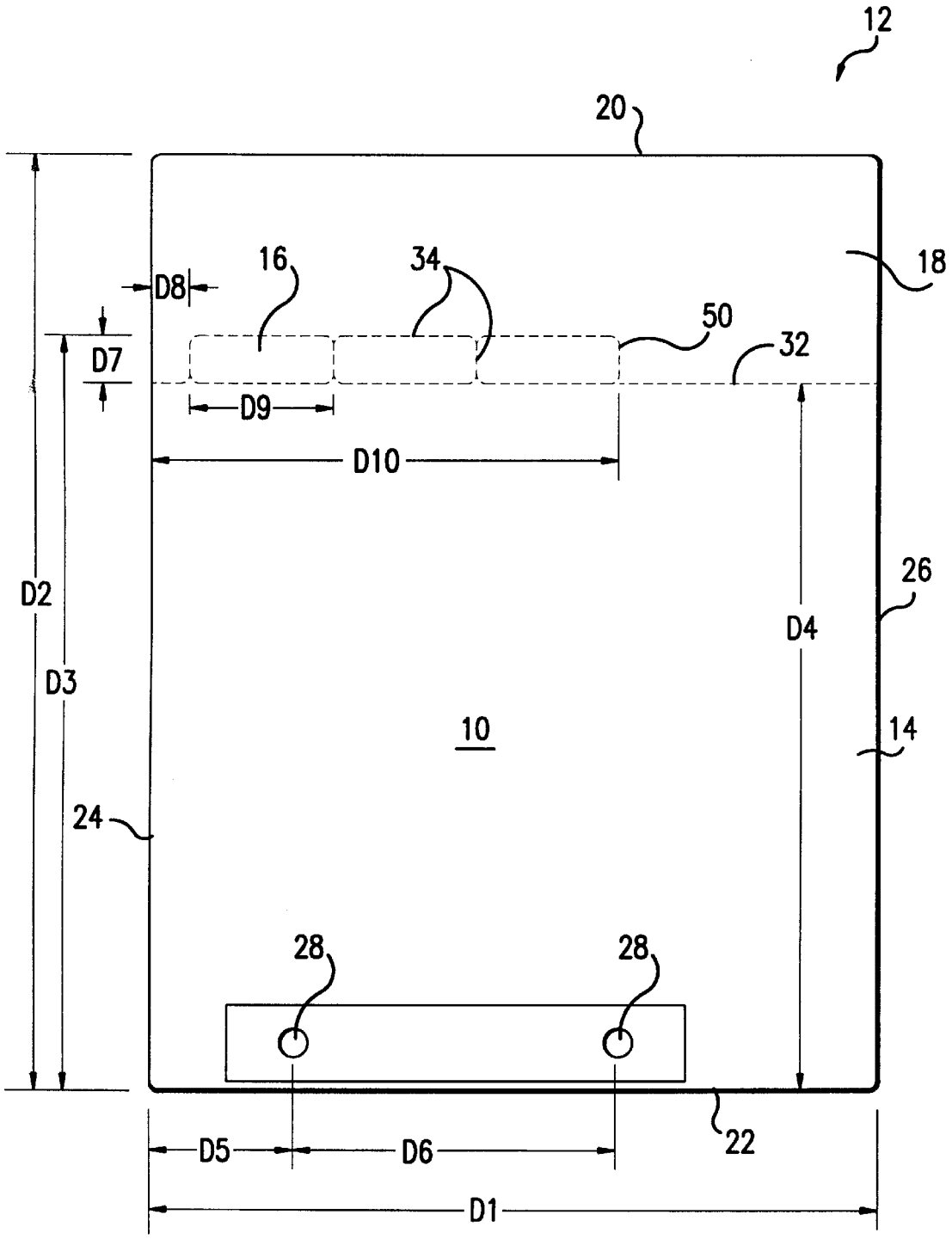
FIG. 1 is a diagrammatic top plan view of an exemplary embodiment of a stock sheet and index sheet of the present invention.

Referring to the embodiments shown in FIGS. 1–4, the index sheet 10 is constructed from a generally planar rectangular stock sheet 12. The index sheet is defined by a main body portion 14 and a single tab portion 16. The stock 10 sheet 12 of the embodiment of FIG. 1 shows the index sheet 10 with a body portion 14 having three tab portions 16 and a guide portion 18. Two of these tab portions and the guide portion 18 will eventually be removed to form a single index sheet 10, as more fully described below.

The stock sheet 12 has opposed spaced apart top 20 and bottom 22 edges and opposed spaced apart first 24 and second 26 side edges. Each of the first 24 and second 26 side edges are generally perpendicular to each of the top 20 and bottom 22 edges.

The stock sheet 12 may be formed, for example, of a substantially pure paper based medium or a composite material such as a paper/plastic laminate. One example of a paper/plastic laminate is a product known as Duralon™ which is made by Arlon, Adhesives and Film Division, of Santa Ana, Calif. Duralon™ has a tear resistant plastic film bonded between two layers of premier stock. It can be used with common office printers such as laser, ink jet, and dot matrix printers, as well as office copiers.

The stock sheet 12 includes a plurality of holes 28 along the bottom edge 22. The holes 28 are used for attaching the index sheet 10 to a looseleaf binder, such as a standard 3-ring binder 30 (shown in FIG. 6), after it has been printed upon and removed from the stock sheet, as described below. The holes may be optionally reinforced. The index sheet 10 and guide portion 18 are separated from each other by perforations 32, 34. The perforations 32 extend across the main sheet from one side 24 to the other side 26. The edge of perforations 32 form the tab edge along which the index tab portions 16 are disposed. The perforations 34 define the three tabs 16.

The lines of perforations 32, 34 form a tearable joint between the guide portion 18, the index sheet body portion 14 and index tab portions 16. The perforations are preferably micro perforations formed by die cutting. Although a number of index tab portions 16 may be retained on each index sheet 10, it is preferable to use only one index tab portion per index sheet. Therefore, one index tab portion 16 is selected and the remaining index tab portions 16 are removed by tearing along the perforations 32, 34.

Guide portion 18 is included to enable the stock sheet 12 to travel through a printing machine 36 (FIG. 5) in a proper and controlled manner, with the stock sheet having a standard feed stock document size and shape. A standard feed stock document includes sizes such as 8½×11 inches (letter size), 8½×14 inches (legal size), 11×17 inches, 8.27×11.69 inches (A4 size), and other conventional sizes.

Figure 2:
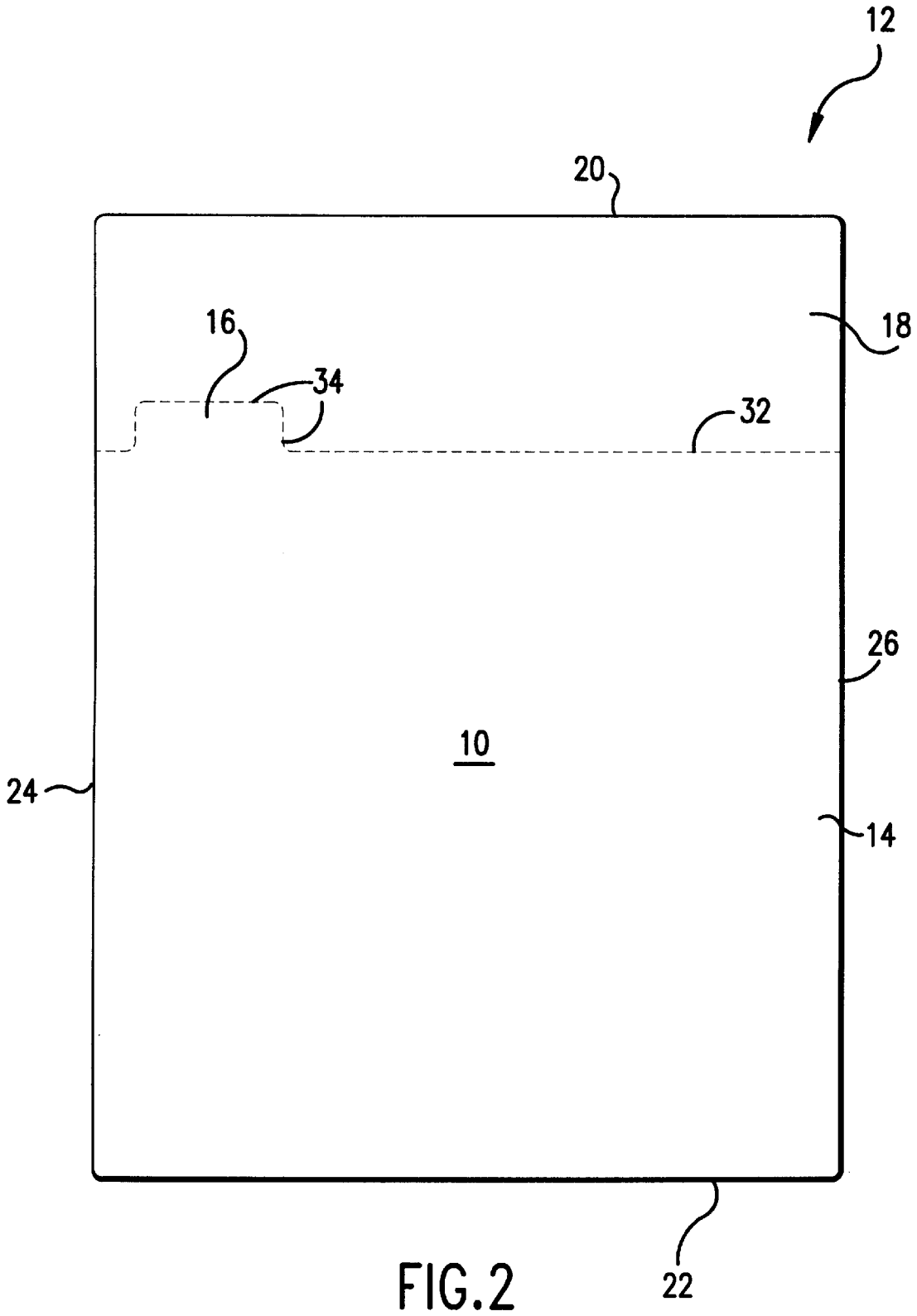
FIG. 2 is a diagrammatic top plan view of another embodiment of the stock sheet and index sheet of the present invention.

As is shown in FIG. 2, instead of a plurality of potential index tab portions 16 being defined on each stock sheet, it may be desirable to have only one index tab portion 16. If the embodiment of FIG. 2 is utilized, it will be necessary to determine which tab location is desired before placing the stock sheet 12 in a printing machine 36 for printing. In addition, holes 28 are not shown in FIG. 2 and it should be noted that there are instances where holes 28 are not desirable or necessary. Therefore, holes 28 are optional.

Figure 3:
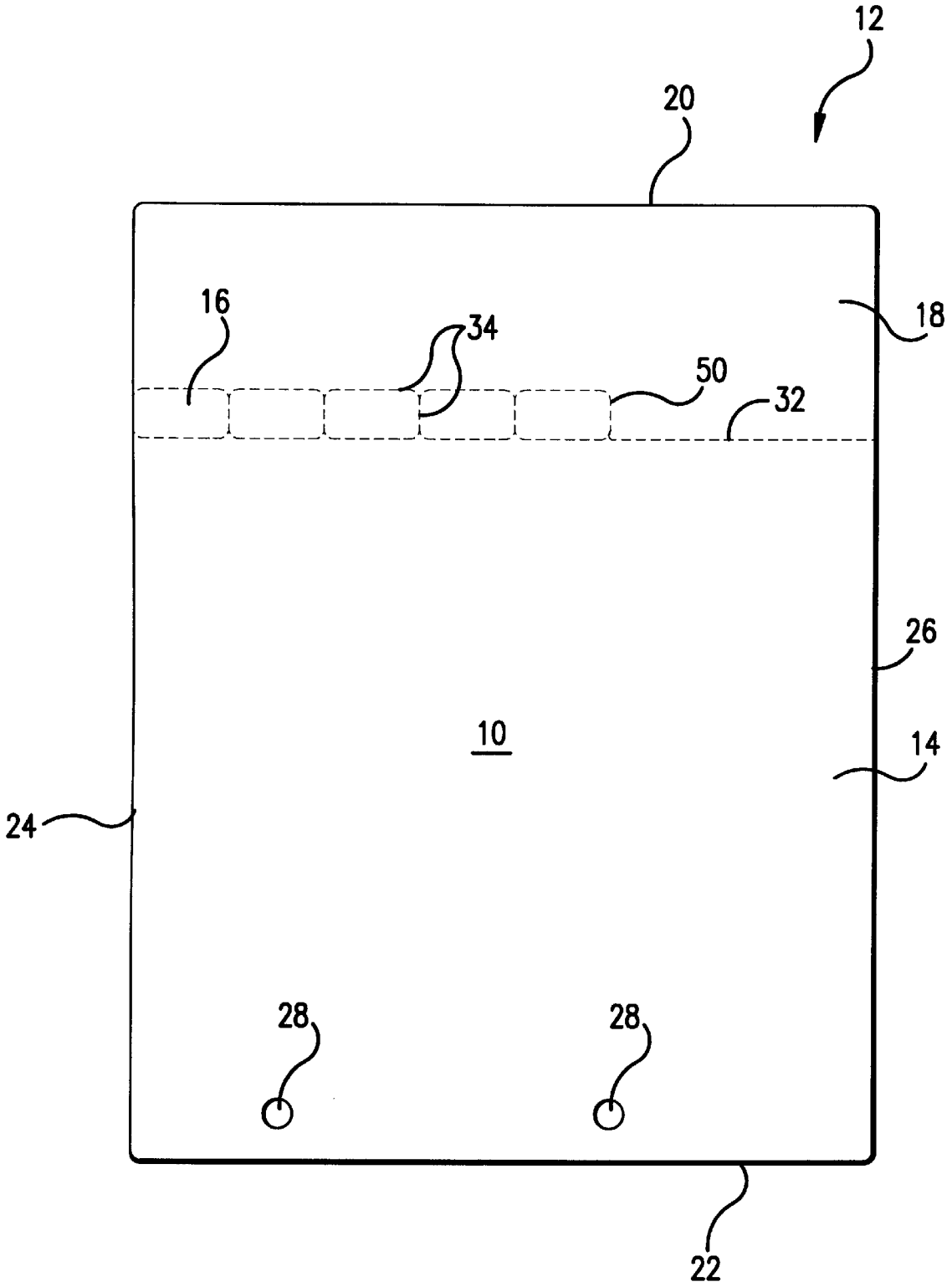
FIG. 3 is a diagrammatic top plan view of yet another embodiment of the stock sheet and index sheet of the present invention.

FIG. 3 shows another embodiment of the present invention where five index tabs 16 are present. In this embodiment, when ten index sheets are properly placed with the material being indexed, they will create a succession of 10 staggered index tab portions along the length of the materials being indexed.

Figure 4:
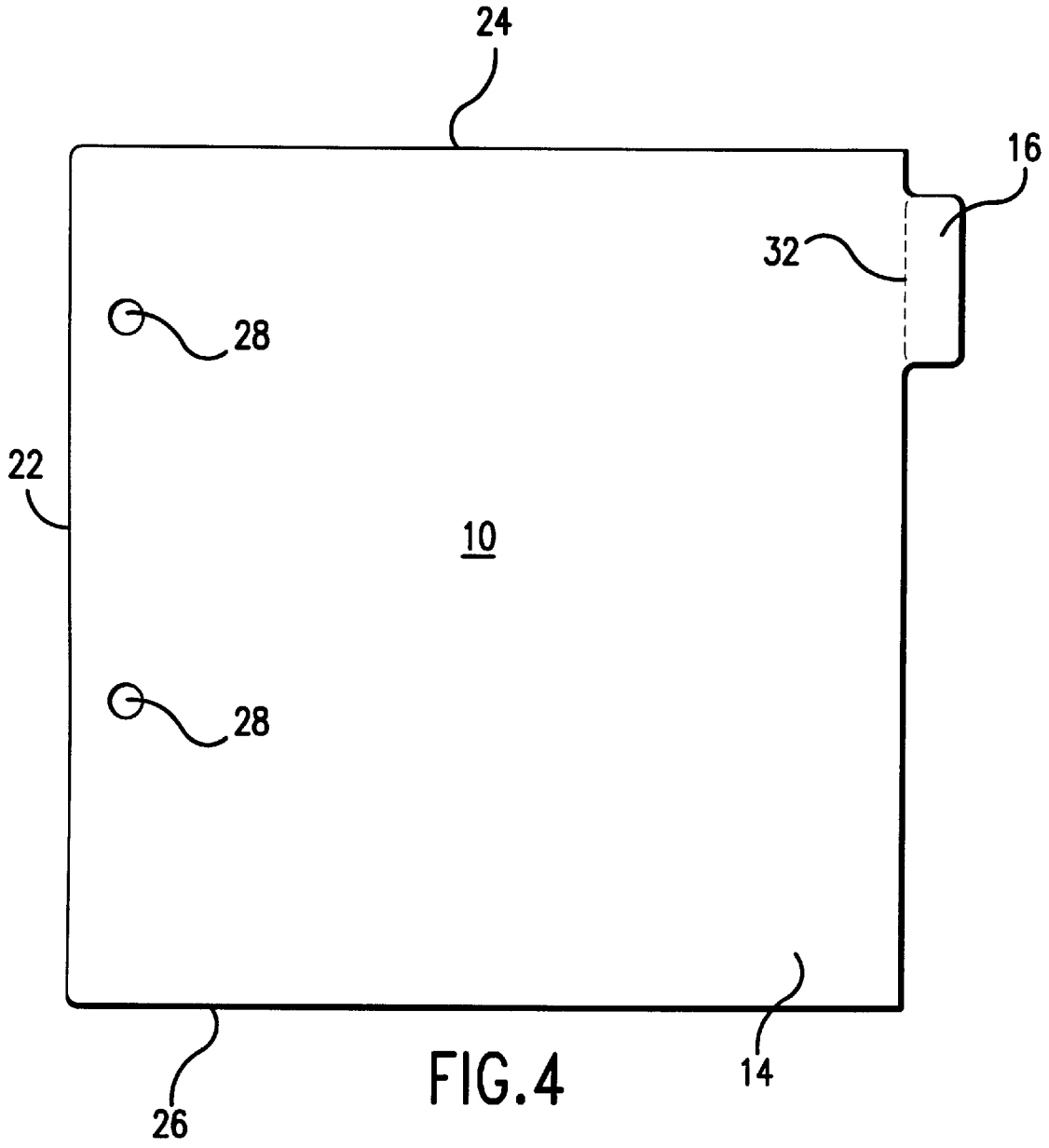
FIG. 4 is a view similar to FIGS. 1 and 2, of the index sheet after removal from the stock sheet.

In FIG. 4, the index sheet shown in FIGS. 1 and 2 is depicted in a transformed state, that it, after removal from the stock sheet 12. The transformed index sheet 10 shows the index sheet of the present invention as including the body portion 14 and a single index tab portion 16. The guide portion 18 has been removed. In addition, the additional index tab portions 16, shown in FIG. 1, have been removed so that only one index tab portion remains. The index sheet 10 shown in FIG. 4 is shorter in length than a standard sized sheet of paper and shorter than a conventional index sheet. Since, for printing purposes, a standard sized sheet of material is used as the stock sheet, removal of the guide portion 18 results in a smaller than standard size index sheet being formed.

In the embodiments shown in FIGS. 1–4, a standard sized stock sheet is preferred. As shown in FIG. 1, D1 represents the width of the stock sheet 12 and D2 represents its length. D3 is the finished width of the index sheet 10 when the guide portion 18 has been removed and an index tab portion 16 remains. Distance D3 is preferably longer than the width of the materials being indexed so that index tab portion 16 extends outwardly from and is not obscured by the materials being indexed. D4 is the finished width of body portion 14 of the index sheet. D4 is preferably about equal to or slightly greater than the width of the materials being indexed. D5 is the distance between first side edge 24 and first hole 28 and D6 is the distance between first and second holes. Distances D5 to D6 are sized to fit in a binder 30, such as the binder shown in FIG. 6. Distance D7 is the height of index tab portion 16 and will vary based upon the tab height desired. Distance D8 represents the space between first side edge 24 and first index tab portion. D9 is the width of each individual tab portion 16 and is variable based upon the number of index tab portions 16 desired. D10 is the width that the tab portions 16 extend across the stock sheet.

For the configuration shown in FIG. 1, D10 equals D5 plus D6.

Using an 8½×11 inch document for illustration purposes, the main body portion 12 has a distance D1 of 8½ inches and a distance D2 of 11 inches. With an 8½×11 inch stock sheet 12, letter size, A4 size, and legal size materials, among others may be indexed. D3 is preferably about 9 inches so that index tab portions 16 extend outwardly past the edge of the materials being indexed. D4 is preferably about 8½ inches when the index sheet 10 is to be used to index materials which are about 8½ inches wide. Distance D5 is preferably about 1.25 inches and distance D6 is preferably about 4.25 inches. Distance D6 is preferably equivalent to the distance between the rings of the ring binders being utilized and may vary depending upon the type of binder used. For a standard 3 ring-type binder, a distance D6 of 4.25 inches is desirable. Distance D7 is preferably about 0.5 inches. D8 is preferably about 0.375 inches. D9, for three tab portions, as shown in FIG. 1, is preferably about 1.7 inches wide. D9 is variable depending upon the number of index tab portions 16 utilized. D10, for this configuration, equals D5 plus D6 or 5.5 inches. All of these dimensions will vary based upon the main body size selected, the number of tabs desired, the type of binder utilized, and the type of materials being indexed.

Figure 5:
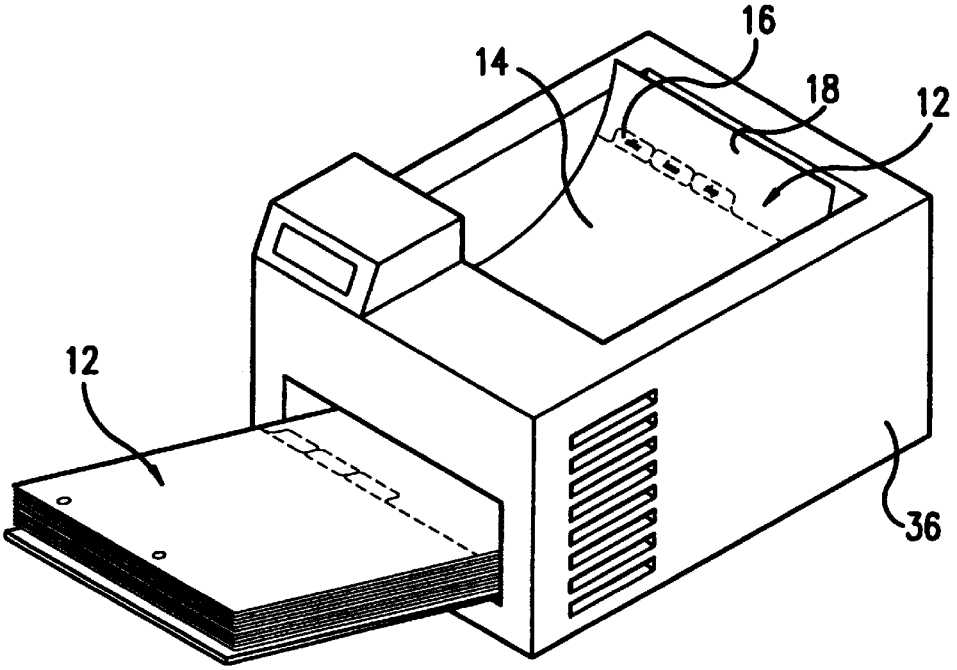
FIG. 5 is a diagrammatic perspective view of a conventional printer receiving a plurality of index sheets of the index sheets shown in FIG. 1.

FIG. 5 shows the index sheet 10 of the embodiment of FIG. 1, being utilized in a computer printer 36, such as a laser printer. As is evident, it is possible to print on the individual index tab portions 16. The printer 36 preferably utilizes a software program which is capable of selectively formatting text areas on the index tab portion 16 and/or on the body portion 14, if desired.

In addition, the index sheet of the present invention may be utilized in any type of printing machine 36 which takes standard sized documents. Types of machines include copiers, laser, ink jet, and dot matrix printers, and the like.

In operation, a stock sheet 12 is fed into a printing machine in a first direction in order to print on the index tab portion 16 and/or on the body portion 14. The first direction is the lengthwise direction, with either the top 20 or the bottom 22 edge being fed in first. After the stock sheet 12 has exited the printing machine 36, it is transformed into the index sheet 10 by removing the guide portion 18 and any extra index tab portions 16 so that the body portion 14 and a single index tab portion 16 remain. The index sheet 10 is then rotated 90° to face in a second direction so that the side edges 24, 26 are positioned at the top and bottom and the index tab portion 16 extends outwardly from the side (as shown in FIG. 3). The bottom edge 22 forms a binding edge and the holes 28 may be positioned along the binding edge. When the index sheet has been rotated in this manner, the holes 28 will be disposed along the side (also shown in FIG. 3) and ready for placement in the binder 30 as shown in FIG. 6.

Figure 6:
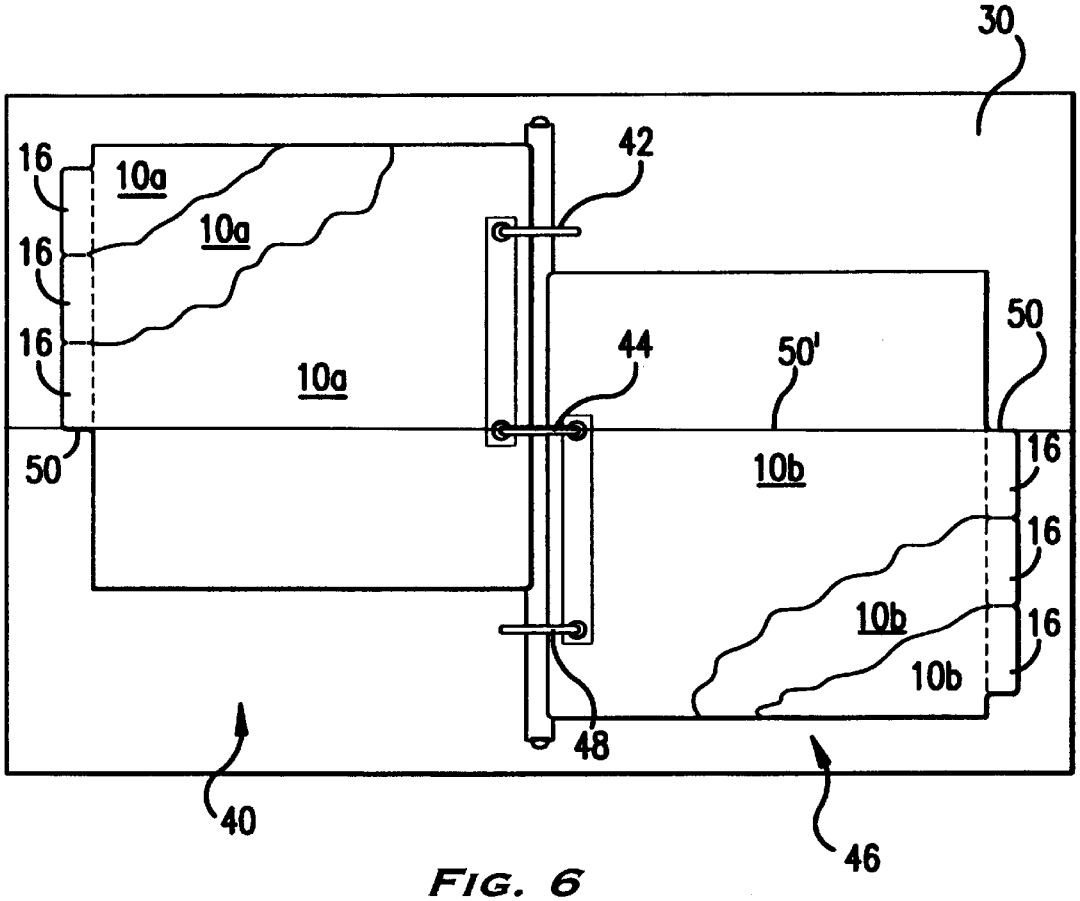
FIG. 6 is diagrammatic perspective view of a conventional looseleaf 3-ring binder supplied with a plurality of index sheets of the present invention.

As shown in FIG. 6, the index sheets are preferably placed one upon the other with the materials to be indexed being positioned between the index sheets. Since the index sheet 10 is generally shorter in length than the materials being indexed, they will not extend along the entire length of the material being indexed if they are all connected into the binder using the same two rings. It is desirable to provide index tab portions 16 which are staggered along the entire length of the material being indexed. To accomplish this result with the index sheet 10 of the present invention, it is necessary to place a first plurality of index sheets 10*a* in the binder 30 in a first position 40 using the top and center rings 42, 44 and a second plurality of index sheets 10*b* in a second position 46 using the center and lower rings 44, 48. This positioning is shown in FIG. 6.

With the index sheets 10*a* and 10*b* located as shown in FIG. 6, it is preferred that the outer edge 50 of inner most tab 16 aligns with the center of the center ring 44 and the corresponding hole 28 in the binding edge of the index sheet. In other words, the edge 50 is aligned with line 50' which is drawn through the hole 28 connected to the center ring 44 and which extends perpendicular to the binding edge of the index sheet. This alignment is desirable so that the index tab portions will be evenly staggered along the entire length of the materials being indexed.

In FIG. 6 there are six index sheets shown. The sheets 10*a* shown on the left are identical to the sheets 10*b* shown on the right. The only difference is that the sheets 10*b* have been inverted. In constructing these sheets 10*a* and 10*b*, two sets of sheets can be formed and then one of the sets inverted to form set 10*b*. To accomplish this, six stock sheets having the shape and configuration of FIG. 1 would be fed through the printer. The first three sheets would be fed through the printer with one side facing the printing mechanism. The second three sheets would be fed with the reverse side facing the printing mechanism. Each sheet fed through the printer would have one of the tab portions printed upon.

Alternatively, the tab portions 16 shown in FIG. 1 could be sized and positioned across the entire width of the stock sheets 12. A number of these sheets corresponding to the number of tabs would be fed through the printer with one side facing the printing mechanism. Then the required number of additional sheets necessary to provide the desired number of tab portions for the binder would be fed through in an inverted position to receive printing on the other side of the tabbed portions.

Still another alternative would include portions extending either partially across or entirely across the width of the stock sheet 12 and with the hole 28 locations for the binder rings being located so as to permit the receipt of the finished index sheets in either the top and center rings or the center and bottom rings of the binder. With this construction alternative hole locations can be provided by perforations with only the required two holes being used as dictated by the necessary placement of the particular index sheet in the binder.

It should be readily apparent to those skilled in the art that any number of tabs may be utilized on the index sheets of the present invention. Therefore, the embodiments shown are meant for illustration purposes only. It is only necessary that the index tabs be large enough to accept printed matter from a printing machine 36. For instance, it would be possible, with the present invention, to create index tabs which identify the various letters of the alphabet, A–Z, or 26 index tab portions, 13 per stock sheet 12.

In addition, while index tab portions 16, shown in FIGS. 1–6 are evenly sized, there may be instances where unevenly sized index tab portions are desirable. It should be readily evident that the present invention is not limited to evenly sized index tab portions 16. Any size or shape may be utilized if desired. For instance, rectangular tab portions are depicted in the figures. However, square, rounded, triangular or any other usable shape may be utilized if desired.

Further, while a three ring binder system has been used herein for illustration purposes, it should be noted that the present invention may be used with any size or type of binder system. For example, an index sheet 10 could be used with a four ring binder by varying the width that the tabs 16 extend across the index sheet 10. By varying this width any number of index sheets 10 can be used together to form a succession of staggered index tab portions 16.

It should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention accordingly is to be defined as set forth in the appended claims.

I claim:

1. A stock sheet for forming an index sheet for indexing materials having a predetermined length and a predetermined width, wherein:

said stock sheet has opposed top and bottom edges, defining a stock length therebetween, opposed side edges, defining a stock width therebetween, and being configured and dimensioned to be fed lengthwise through a printing machine, said stock width is less than said stock length and less than said predetermined length;

said stock sheet is comprised of an index sheet and a guide portion;

the guide portion being removable along perforations from the stock sheet and index sheet;

the index sheet having a binding edge defined by the bottom edge of the stock sheet and a tab edge extending across the stock sheet between its side edges and located adjacent its top edge and spaced therefrom by said guide portion;

the index sheet further including a body portion bounded by the bottom and side edges of the stock sheet, and at least one tab portion located along said tab edge and extending outwardly from the body portion in a direction toward the top edge of the stock sheet; and said body portion of the index sheet having a dimension, as measured between the binding edge and the tab edge of the index sheet, which is at least substantially equal to the predetermined width of said materials being indexed, with the tab portion extending outwardly from said body portion.

2. The stock sheet of claim 1, wherein the tab edge is substantially parallel to the bottom edge.

3. The stock sheet of claim 1, wherein a plurality of holes are positioned along the binding edge.

4. The stock sheet of claim 3, wherein at least two holes are located along the binding edge.

5. The stock sheet of claim 4, wherein the at least two holes are reinforced.

6. A plurality of stock sheets for forming a plurality of different index sheets for indexing materials having a predetermined length and a predetermined width and held along said predetermined length on spaced rings of a ring binder, wherein:

each of said stock sheets having opposed top and bottom edges, defining a stock length therebetween, and opposed first and second side edges, defining a stock width therebetween, said stock sheet further having a rectangular shape and being configured and dimensioned to be fed lengthwise through a printing machine;

each of said stock sheets has a stock width less than said stock length and less than said predetermined length; each of said stock sheets is comprised of an index sheet and a guide portion;

the guide portion being removable along perforations from the stock sheet and index sheet;

the index sheet having a binding edge defined by the bottom edge of the stock sheet and a tab edge extending across the stock sheet between its side edges and located adjacent its top edge and spaced therefrom by said guide portion;

the index sheet further including a body portion bounded by the bottom and side edges of the stock sheet, and at least one tab portion located along said tab edge and extending outwardly from the body portion in a direction toward the top edge of the stock sheet;

said body portion of the index sheet having a dimension, as measured between the binding edge and the tab edge of the index sheet, which is substantially equal to the predetermined width of said materials being indexed, with the tab portion extending outwardly of said body portion; and a pair of hole locations disposed along the binding edge of the index sheet, said hole locations being oriented relative to the tab location across the tab edge of the stock sheet whereby different index sheets with a different tab location can be positioned on the rings of a ring binder to orient the tab portion on each index sheet in a different location along said predetermined length of said materials being indexed.

7. The stock sheets of claim 6, wherein the pair of holes are reinforced.

8. The stock sheet of claim 6, wherein the holes are spaced so as to fit on two adjacent rings of a standard sized three-ring binder having two end rings and a center ring.

9. The stock sheets of claim 8, wherein the stock sheets are comprised of two identical sets of sheets, with one stock sheet of each set including an index sheet with a tab portion having an edge aligned with a line drawn through one of said holes and extending perpendicular to the binding edge of the index sheet, said hole being the hole for connecting to the center ring of said three-ring binder.

10. The stock sheet of claim 9, wherein the index tab portions are evenly sized.

* * * * *